US006661899B1

(12) United States Patent
Phinisee-Washington

(10) Patent No.: US 6,661,899 B1
(45) Date of Patent: Dec. 9, 2003

(54) BOOK MICROPHONE SYSTEM

(76) Inventor: Ollette Phinisee-Washington, 3301 W. 20th Ave., Gary, IN (US) 46404

( * ) Notice: Subject to any disclaimer, the term of this patent is extended or adjusted under 35 U.S.C. 154(b) by 0 days.

(21) Appl. No.: 09/470,751

(22) Filed: Dec. 23, 1999

(51) Int. Cl.[7] ..... H04R 1/02

(52) U.S. Cl. ..... 381/91; 381/334; 381/361; 381/366; 434/318

(58) Field of Search ..... 381/300, 301, 381/333, 334, 355, 361, 362, 365, 366, 386, 390, 77, 79; 434/317, 318, 319, 320

(56) References Cited

U.S. PATENT DOCUMENTS 2,484,895 A 10/1949 Links
4,166,926 A * 9/1979 Sieler ..... 381/75
D295,538 S 5/1988 Stajan et al.
4,809,246 A 2/1989 Jeng
5,404,444 A 4/1995 Billings
5,511,980 A 4/1996 Wood
5,631,883 A 5/1997 Li
D436,100 S * 1/2001 Taylor ..... D14/226

OTHER PUBLICATIONS

Copy of Avon catalog page featuring "Sing–Along Bible Songs Electronic Book". Avon International, Inc. Page and date unknown.

* cited by examiner

*Primary Examiner*—Minsun Oh Harvey

(57) ABSTRACT

A book microphone system for allowing children to hear themselves read. The book microphone system includes a combination reading book and microphone system. The microphone system includes an amplifier for amplifying sounds detected by a microphone and a speaker for reproducing said sounds. The inventive device also includes a means for removably attaching the microphone, speaker and amplifier to the book for storage.

11 Claims, 2 Drawing Sheets

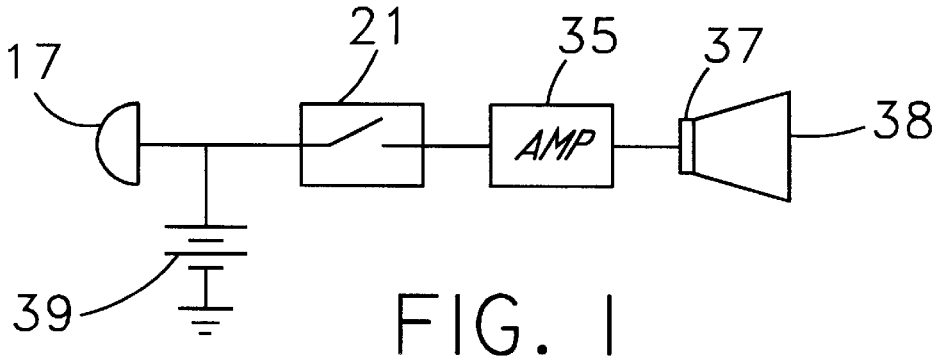
FIG. 1
FIG. 2
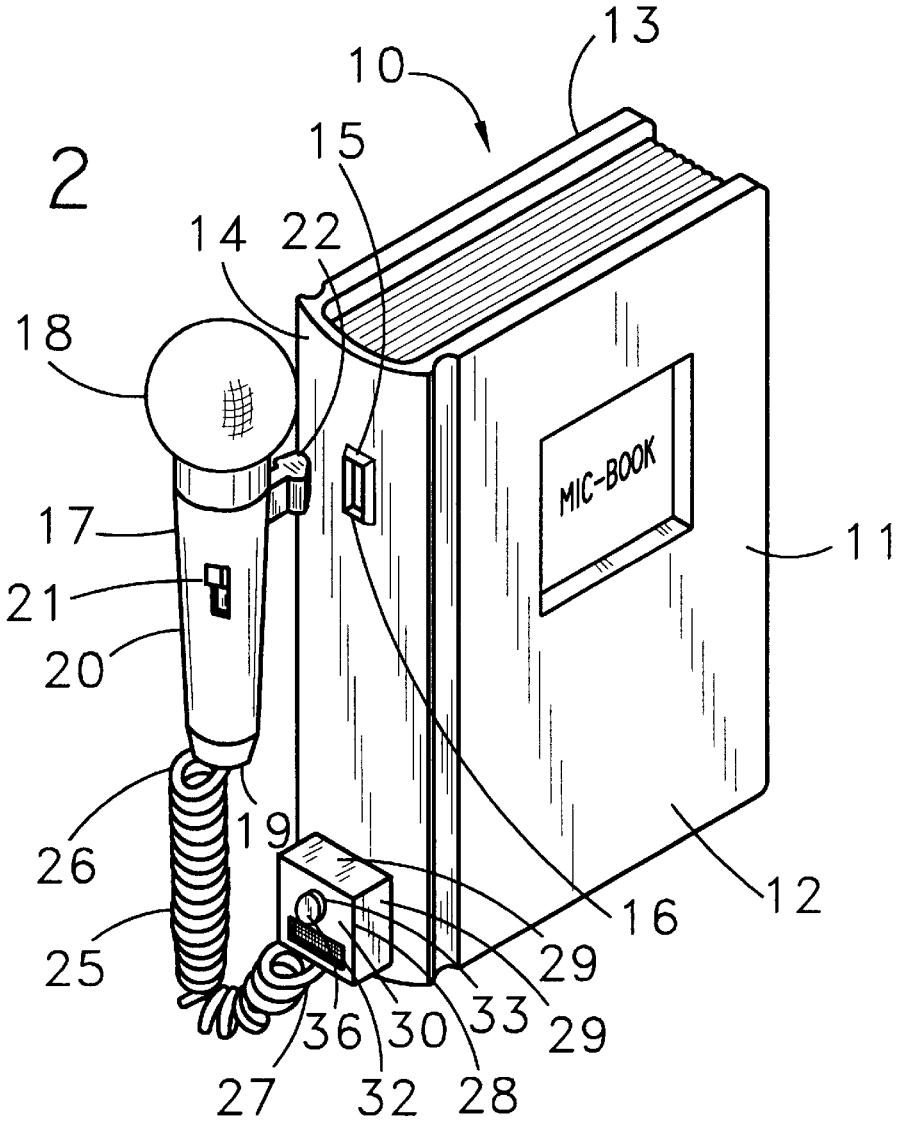

BOOK MICROPHONE SYSTEM

BACKGROUND OF THE INVENTION

1. Field of the Invention

The present invention relates to books in combination with speakers that produce audio message and more particularly pertains to a new book microphone system for allowing children to hear themselves read.

2. Description of Prior Art

The use of books in combination with speakers that produce audio messages is known in the prior art. More specifically, books in combination with speakers that produce audio messages heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,511,980; 5,631,883; 5,404,444; 4,809,246; 295,538; and 2,484,895.

While these devices fulfill their respective, particular objectives and requirements, the aforementioned patents do not disclose a new book microphone system. The inventive device includes a combination reading book and microphone system. The microphone system includes an amplifier for amplifying sounds detected by a microphone and a speaker for reproducing said sounds. The inventive device also includes a means for removably attaching the microphone, speaker and amplifier to the book for storage.

In these respects, the book microphone system according to the present invention substantially departs from the conventional concepts and designs of the prior art, and in so doing provides an apparatus primarily developed for the purpose of allowing children to hear themselves read.

SUMMARY OF THE INVENTION

In view of the foregoing disadvantages inherent in the known types of books in combination with speakers that produce audio messages now present in the prior art, the present invention provides a new book microphone system construction wherein the same can be utilized for allowing children to hear the themselves read.

The general purpose of the present invention, which will be described subsequently in greater detail, is to provide a new book microphone system apparatus and method which has many of the advantages of the books in combination with speakers that produce audio messages mentioned heretofore and many novel features that result in a new book microphone system which is not anticipated, rendered obvious, suggested, or even implied by any of the prior art books in combination with speakers that produce audio messages, either alone or in any combination thereof.

To attain this, the present invention generally comprises a combination reading book and microphone system. The microphone system includes an amplifier for amplifying sounds detected by a microphone and a speaker for reproducing said sounds. The inventive device also includes a means for removably attaching the microphone, speaker and amplifier to the book for storage.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new book microphone system apparatus and method which has many of the advantages of the books in combination with speakers that produce audio messages mentioned heretofore and many novel features that result in a new book microphone system which is not anticipated, rendered obvious, suggested, or even implied by any of the prior art books in combination with speakers that produce audio messages, either alone or in any combination thereof.

It is another object of the present invention to provide a new book microphone system that may be easily and efficiently manufactured and marketed.

It is a further object of the present invention to provide a new book microphone system which is of a durable and reliable construction.

An even further object of the present invention is to provide a new book microphone system which is susceptible of a low cost of manufacture with regard to both materials and labor, and which accordingly is then susceptible of low prices of sale to the consuming public, thereby making such book microphone system economically available to the buying public.

Still yet another object of the present invention is to provide a new book microphone system which provides in the apparatuses and methods of the prior art some of the advantages thereof, while simultaneously overcoming some of the disadvantages normally associated therewith.

Still another object of the present invention is to provide a new book microphone system for allowing children to hear themselves read.

Yet another object of the present invention is top provide a new book microphone system which includes a combination reading book and microphone system. The microphone system includes an amplifier for amplifying sounds detected by a microphone and a speaker for reproducing said sounds.

The inventive device also includes a means for removably attaching the microphone, speaker and amplifier to the book for storage.

Still yet another object of the present invention is to provide a new book microphone system that encourages children to enjoy reading.

Even still another object of the present invention is to provide a new book microphone system that amplifies the voice of the person reading the book out loud.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic diagram of the electronic circuit of the new book microphone system according to the present invention.

FIG. 2 is a schematic perspective view of a book having the present invention mounted thereon.

DESCRIPTION OF THE PREFERRED EMBODIMENT

Figure 3:
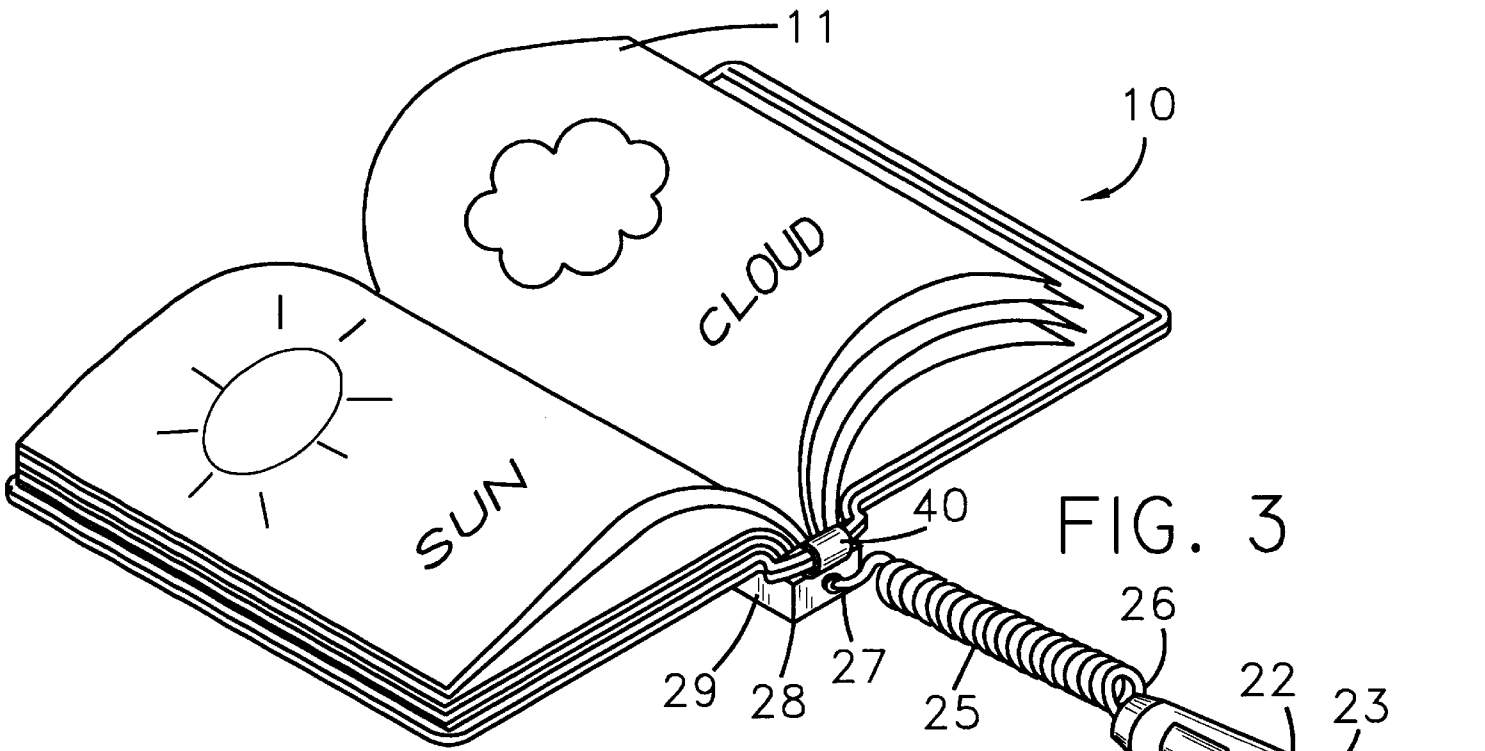
FIG. 3 is a schematic perspective view of the present invention with the book in a open position and having a microphone extended therefrom.

With reference now to the drawings, and in particular to FIGS. 1 through 4 thereof, a new book microphone system embodying the principles and concepts of the present invention and generally designated by the reference numeral 10 will be described.

As best illustrated in FIGS. 1 through 4, the book microphone system 10 generally comprises a book 11 for reading that has a front cover 12, a back cover 13 and a spine cover 14. The spine cover 14 forms a chamber 15 with an opening 16. The opening 16 has a width and length.

The invention also includes a microphone 17 with a first end 18, a second end 19, and a middle portion 20 in between the first end 18 and the second end 19 forming a handle. The middle portion 20 of the microphone 17 has a switch 21 for turning on and off the microphone 17. The middle portion 20 of the microphone 17 is preferably frusto-conical in shape (see FIG. 2).

Figure 4:
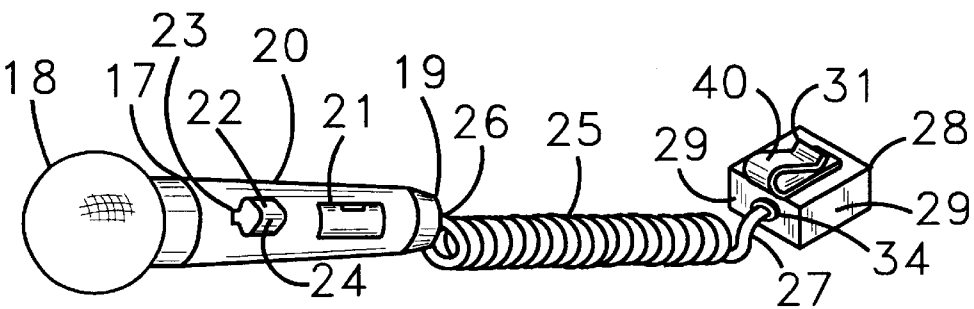
FIG. 4 is a schematic perspective view of the microphone, cord and housing of the present invention disconnected from the book.

A stem 22 for securing the microphone 17 the book 11 is coupled to the middle portion 20 of the microphone 17 (see FIGS. 2–4). The stem 22 is made of a semi-pliable material. A first end 23 of the stem 22 is attached to the middle portion 20 of the microphone 17 and is narrower than a second end 24 of the stem 22. The second end 24 of the stem 22 preferably has a length substantially equal to the length of the opening 16 in the spine cover 14 of the book 11. The width of the second end 24 of the stem 22 is slightly larger than the width of the opening 16 in the spine cover 14 of the book 11 for forming an interference fit between the second end 24 and the opening 16. The second end 24 of the stem 22 can be forcibly inserted into and removed from the opening 16 in the spine cover 14 for effecting storage of the microphone 17 on the spine cover 14 of the book 11.

A coiled cord 25 is included for electronically transmitting electrical signals representing sounds picked up by the microphone 17 (see FIGS. 2–4). The coiled cord 25 has a first end 26 and a second end 27. The first end 26 is connected to the second end 19 of the microphone 17.

The invention also includes a housing 28. The housing 28 is preferably rectangular in shape and has a depth defined by four edge walls 29. The housing 28 has a front side 30 and a back side 31. The housing 28 is substantially hollow with its front side 30 having an opening 32 and a bore 33. One of the edge walls 29 of the housing 28 also has a bore 34.

An amplifier 35 for amplifying sounds detected by the microphone 17 is located inside the housing 28. The second end 27 of the coiled cord 25 is connected to the amplifier 35 through the bore 34 in one of the edge walls 29 of the housing 28 (see FIG. 4).

A volume control knob 36 is provided for controlling the level of amplification, the volume control knob 36 is rotatably attached to the amplifier 35 through the bore 33 in the front side 30 of the housing 28. The volume control knob 36 is accessible to the operator on the front side 30 of the housing 28 (see FIG. 2).

A speaker 37 for producing sound from the electrical signals produced by the microphone 17 and amplified by the amplifier 35 is located inside the housing 21. A cone 38 of the speaker 37 is preferably aligned with the opening 32 on the front side 30 of the housing 28. The speaker 37 is electronically connected to the amplifier 35 (see FIG. 1). Preferably, a standard dry cell battery 38 powers the book microphone system to 10.

A clip 40 for removably securing the housing 28 to the spine cover 14 of the book 11 is illustrated in FIG. 4. The clip 40 is substantially U-shaped. One side of the U-shape is attached to the back side 31 of the housing 28. The clip 40 is attachable to an edge of the spine cover 14 of the book 11 for effecting storage of the housing 28 on the spine cover 14 of the book 11 as illustrated in FIGS. 2–3.

In use, the operator simply detaches the microphone 17 and the housing 28 from the spine cover 14 of the book 11 and turns on the switch 21 on the microphone 17. The operator then simply reads into the microphone 17 and their voice is amplified.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A book microphone system comprising:

a microphone;

a housing having an interior;

an amplifier in the housing for amplifying sounds detected by the microphone, the amplifier being electronically connected to the microphone;

a speaker in the housing for reproducing the sounds detected by the microphone, the speaker being electronically connected to the amplifier;

a housing attachment means for removably attaching the housing to a book for storage;

a book having a spine cover forming a chamber, the spine cover having a opening to the chamber, the opening having a width and length; and a microphone attaching member further comprising a stem for securing the microphone to the book, the stem being made of a semi-pliable material, the stem having a first end and a second end, the first end being narrower than the second end, the first end of the stem being attached to the microphone, the second end of the stem having a length substantially equal to the length of the opening in the spin cover of the book, the second end of the stem having a width slightly larger than the width of the opening in the spine cover of the book, wherein the second end of the stem operatively connected to be forcibly inserted into and removed from the opening in the spine cover for effecting storage of the microphone on the spine cover of the book.

2. The book microphone system of claim 1, wherein the housing is substantially rectangular in shape and has a depth defined by four edge walls, the housing having a front side and a back side, the housing being substantially hollow, the front side of the housing having an opening, the speaker having a cone aligned with the opening on the front side of the housing.

3. The book microphone system of claim 1 wherein the microphone has a first end for speaking into, a second end, and a middle portion in between the first end and second end, the middle portion forming a handle substantially frusto-conical shape, the middle portion having a switch for selectively supplying power to the amplifier.

4. The book microphone system of claim 1 further comprising a volume control knob for controlling the level of amplification, the volume control knob being rotatably attached to the amplifier.

5. The book microphone system of claim 1 further comprising a coiled cord for electronically transmitting electrical signals representing sounds picked up by the microphone, the coiled cord having a first end and a second end, the first end being connected to the microphone, the second end being connected to the amplifier.

6. A book microphone system comprising:

a microphone;

a housing having an interior;

an amplifier in the housing for amplifying sounds detected by the microphone, the amplifier being electronically connected to the microphone;

a speaker in the housing for reproducing the sounds detected by the microphone, the speaker being electronically connected to the amplifier;

a housing attachment means for removably attaching the housing to a book for storage; and wherein the housing attachment means comprises a clip for removably securing the housing to the spine cover of the book, the clip being substantially U-shaped with a pair of sides, one side of the U-shape being attached to the housing, the other side of the U-shaped clip being attachable to an edge of the spine cover of the book for effecting storage of the housing on the spine cover of the book.

7. The book microphone system of claim 6 wherein the housing is substantially rectangular in shape and has a depth defined by four edge walls, the housing having a front side and a back side, the housing being substantially hollow, the front side of the housing having an opening, the speaker having a cone aligned with the opening on the front side of the housing.

8. The book microphone system of claim 6 wherein the microphone has a first end for speaking into, a second end, and a middle portion in between the first end and second end, the middle portion forming a handle substantially frusto-conical shape, the middle portion having a switch for selectively supplying power to the amplifier.

9. The book microphone system of claim 6, further comprising:

a volume control knob for controlling the level of amplification, the volume control knob being rotatably attached to the amplifier.

10. The book microphone system of claim 6, further comprising:

a coiled cord for electronically transmitting electrical signals representing sounds picked up by the microphone, the coiled cord having a first end and a second end, the first end being connected to the microphone, the second end being connected to the amplifier.

11. A combination book and microphone comprising:

a book for reading having a front cover, a back cover and a spine cover forming a chamber, the spine cover having a opening to the chamber, the opening having a width and length;

a microphone having a first end for speaking into, a second end, and a middle portion in between the first end and the second end forming a handle substantially frusto-conical in shape, the middle portion having a switch;

a stem for securing the microphone to the book, the stem being made of a semi-pliable material, the stem having a first end and a second end, the first end being narrower than the second end, the first end of the stem being attached to the middle portion of the microphone, the second end of the stem having a length substantially equal to the length of the opening in the spin cover of the book, the second end of the stem having a width slightly larger than the width of the opening in the spine cover of the book wherein the second end of the stem operatively connected to be forcibly inserted into and removed from the opening in the spine cover for effecting storage of the microphone on the spine cover of the book;

a coiled cord for electronically transmitting electrical signals representing sounds picked up by the microphone, the coiled cord having a first end and a second end, the first end being connected to the second end of the microphone;

a housing, the housing being substantially rectangular in shape having a depth defined by four edge walls, the housing having a front side and a back side, the housing being hollow, the front side of the housing having an opening and a bore, one of the edge walls of the housing also having a bore;

an amplifier for amplifying sounds detected by the microphone, the amplifier being located inside the housing, the second end of the coiled cord being connected to the amplifier through the bore in the edge wall of the housing;

a volume control knob for controlling the level of amplification, the volume control knob being rotatably attached to the amplifier through the bore in the front side of the housing whereby the volume control knob is accessible to the operator on the front side of the housing;

a speaker having a cone for producing sound from the electrical signals produced by the microphone and amplified by the amplifier, the speaker being located inside the housing in such a manner that the cone of the speaker is aligned with the opening on the front side of the housing, the speaker being electronically connected to the amplifier;

a clip for removably securing the housing to the spine cover of the book, the clip being substantially U-shaped with a pair of sides, one side of the U-shape being attached to the back side of the housing, the other side of the U-shaped clip being attachable to an edge of the spine cover of the book for effecting storage of the housing on the spine cover of the book.

* * * * *